US005131951A

United States Patent [19]

Yoshida et al.

[11] Patent Number: 5,131,951

[45] Date of Patent: Jul. 21, 1992

[54] PAPER COATING COMPOSITION

[75] Inventors: Yoshifumi Yoshida, Hyogo; Toshiyuki Hasegawa; Haruo Tanaka, both of Osaka, all of Japan

[73] Assignee: Sumitomo Chemical Co., Ltd., Osaka, Japan

[21] Appl. No.: 741,890

[22] Filed: Aug. 8, 1991

[30] Foreign Application Priority Data

Aug. 10, 1990 [JP] Japan ..... 2-213933
Dec. 5, 1990 [JP] Japan ..... 2-400481
Dec. 21, 1990 [JP] Japan ..... 2-404941

[51] Int. Cl.[5] ..... C08K 5/17; C08K 5/21

[52] U.S. Cl. ..... 106/287.25; 106/287.23; 106/287.24; 106/287.26; 106/400; 106/404; 162/157.3; 427/391; 427/411; 524/608; 525/427

[58] Field of Search ..... 427/391, 411; 524/608; 525/427; 162/157.3; 106/287.23, 287.24, 287.25, 287.26, 400, 401

[56] References Cited

FOREIGN PATENT DOCUMENTS 0220960 5/1987 European Pat. Off. .
51-121041 10/1976 Japan .

*Primary Examiner*—William R. Dixon, Jr.
*Assistant Examiner*—Scott L. Hertzog
*Attorney, Agent, or Firm*—Sughrue, Mion, Zinn Macpeak & Seas

[57] ABSTRACT

A paper coating composition which comprises:
(I) a pigment,
(II) an aqueous binder, and
(II) a resinous ingredient comprising (A) a water-soluble resin which is prepared by cross-linking (a) a condensation product of (al) an alkylenediamine or a polyalkylenepolyamine and (a2) an urea compound with (b) a cross-linking compound. This composition imparts excellent ink receptivity, excellent water resistance, and in particular, excellent anti-blister property to paper.

20 Claims, No Drawings

PAPER COATING COMPOSITION

The present invention relates to a paper coating composition, and more particularly to a composition imparting excellent printing quality and excellent results of printing to paper.

The term "paper" as used herein should be interpreted in its broad sense and includes paper in the narrow sense as well as paperboard.

Coated paper obtained by applying a paper coating composition mainly composed of a pigment and an aqueous binder on paper, followed by necessary steps, such as drying and calendering, is widely used for commercial prints, magazines, books and the like due to its excellent properties such as printed results. With the increasing demand for higher quality and the development of high-speed printing techniques, constant efforts have continued to further improve the coated paper quality. Particularly in the art of offset printing predominating in various printing techniques, it is a weighty subject to improve ink receptivity considering the effects of damping water, water resistance such as wet pick or wet rub, and anti-blister properties at a rotary press.

In order to resolve the above-described problem, it is conventionally known to add to the paper coating composition a wet strength agent or printing quality improver including melamine-formaldehyde resins, urea-formaldehyde resins, or polyamidepolyurea-formaldehyde resins, such as those disclosed in, for example, JP-B-44-11667 and JP-B-59-32597 (the term "JP-B" as used herein means an "examined published Japanese patent application (KOKOKU)").

Although these conventional wet strength agents or printing quality improvers exhibit effective characteristics, each of them has a serious defect or insufficiency in part of the characteristics desired and is not always satisfactory for practical use.

For example, aminoplast resins, e.g., melamineformaldehyde resins and urea-formaldehyde resins, not only cause evolution of formaldehyde from the coating line or from the resulting coated paper but also produce substantially no effect on improving ink receptivity and anti-blister properties. Besides, as the pH of the coating composition increases, the water resistance improving effect by the aminoplast resins becomes less pronounced. Polyamidepolyureaformaldehyde resins are effective for improving not only water resistance but also ink receptivity and anti-blister properties. The degree of improvements attainable by them, however, is not necessarily sufficient against the recent demand for higher quality coated paper. Efforts have hence been made to add further improvements. For example, an improved paper coating composition is proposed in EP-A-0220960. Nevertheless, there still has been a need for further enhanced performance to cope with the ever increasing demand for coated paper quality.

An object of the present invention is to provide a paper coating composition which endows paper with high water resistance and ink receptivity or the like, and in particular, excellent anti-blister properties that have been difficult to obtain by conventional techniques.

Other objects and effects of the present invention will be apparent from the following description.

The present inventors have conducted extensive investigation and, as a result, have found that a paper coating composition containing a specific water-soluble resin exhibits excellent performance and have thus completed the present invention.

The present invention provides a paper coating composition which comprises:

(I) a pigment, (II) an aqueous binder, and (III) a resinous ingredient comprising (A) a water-soluble resin which is prepared by cross-linking (a) a condensation product of (al) an alkylenediamine or a polyalkylenepolyamine and (a2) an urea compound with (b) a cross-linking compound.

Resinous ingredient (III) according to the present invention may contain, in addition to water-soluble resin (A), (c) a polyalkylenepolyamine and/or (d) a reaction product of a polyalkylenepolyamine with a quaternarization agent. Polyalkylenepolyamine (c) and/or the reaction product (d) will be hereunder referred to as "polyamine (B)".

Further, resinous ingredient (III) according to the present invention may be (C) a reaction product prepared from water-soluble resin (A) by further reacting with polyamine (B).

The present invention will be explained below in more detail.

Examples of alkylenediamine or polyalkylenepolyamine (a1), which is one of the starting materials for watersoluble resin (A) used in the present invention, include aliphatic diamines such as ethylenediamine and propylenediamine, and polyalkylenepolyamines such as diethylenetriamine, triethylenetetramine, tetraethylenepentamine, iminobispropylamine, 3-azahexane-1,6-diamine and 4,7-diazadecane-1,10-diamine. Among them, diethylenetriamine and triethylenetetramine are preferred from the industrial viewpoint. These alkylenediamines or polyalkylenepolyamines (a1) can be used either alone or in combination.

Examples of urea compound (a2), which is also a starting material for water-soluble resin (A) used in the present invention, include urea, thiourea, guanylurea, methylurea, dimethylurea and the like. Among them, urea is preferably used from the industrial viewpoint. These urea compounds (a2) can be used either alone or in combination.

In the present invention, alkylenediamine or polyalkylenepolyamine (al) and urea compound (a2) are subjected to a condensation reaction to produce condensation product (a), and thereafter condensation product (a) is further subjected to a cross-linking reaction with cross-linking compound (b) to produce water-soluble resin (A).

The condensation reaction between alkylenediamine or polyalkylenepolyamine (a1) and urea compound (a2) is generally carried out at a temperature of from about 100° o about 180° C., and preferably from about 110° to about 160° C., for a period of from about 1 to about 6 hours while driving ammonia produced out of the reaction system (deammoniation). Urea compound (a2) is preferably used in an amount of from 0.5 to 1 mol per mol of the primary and secondary amino groups of alkylenediamine or polyalkylenepolyamine (a1). The reaction may be conducted in two-divided stages, in which a part of urea compound (a2) is reacted with alkylenediamine or polyalkylenepolyamine (a1) at from 120° to 180° C., and preferably from 140° to 160° C., to conduct deammoniation, and then the rest of urea compound (a2) is added thereto and reacted at from 100° to 180° C., and preferably from 110° to 160° C., to complete the deammoniation.

The condensation product (a) thus obtained is further subjected to a cross-linking reaction with cross-linking compound (b) to produce water-soluble resin (A). Crosslinking compound (b) used herein is a compound capable of cross-linking condensation product (a) to make a resinous product, and examples thereof include:

(b1) aldehydes, (b2) epihalohydrins or $\beta,\gamma$-dihalo-$\beta$-hydrins, (b3) reaction products of a urea compound (b3-1) with glyoxal (b3-2), and (b4) melamine-formaldehyde resins.

The cross-linking reaction between reaction product (a) and cross-linking compound (b) is preferably carried out in an aqueous solution having a total content of the components (a) and (b) of from about 20 to about 80% by weight, more preferably from about 30 to about 70% by weight. It is necessary to conduct this reaction under such conditions that cross-linking compound (b) reacts to achieve crosslinking of reaction product (a).

Cross-linking compounds (b) are individually explained hereunder.

Examples of aldehyde (b1) include formaldehyde; alkylaldehydes, such as acetaldehyde and propionaldehyde; glyoxal; and alkyldialdehydes, such as propanedial and butanedial; with formaldehyde and glyoxal being preferred for industrial use. These aldehydes can be used either alone or in combination.

The reaction between condensation product (a) and aldehyde (b1) is generally conducted under a cross-linking condition of a pH of 7 or below, preferably at a pH ranging from 3 to 6. The pH adjustment is preferably carried out by adding an acid such as hydrochloric acid, sulfuric acid, phosphoric acid, formic acid or acetic acid, and the reaction is preferably conducted at a temperature of from about 40° to about 80° C. for a period of from about 1 to about 10 hours.

Alternatively, it is also preferred to conduct the reaction at first in an alkaline region of a pH ranging from 8 to 12, and thereafter to continue the reaction by adjusting the pH to an acidic region of 7 or below, more preferably to a range of 3 to 6. In this embodiment, the reaction under the alkaline condition is conducted at from about 40° to about 80° C. for from about 0.5 to about 5 hours, and the reaction under the acidic condition is conducted at from about 40° to about 80° C. for from about 1 to about 10 hours.

Aldehyde (b1) is used preferably in such an amount that the aldehyde group is from about 0.1 to about 3 mols, more preferably from about 0.3 to about 1.5 mol, per mol of condensation product (a). After completion of the abovementioned reaction, an aqueous solution of water-soluble resin (A) is obtained to be used in the present invention. If necessary, the pH of the reaction solution may be adjusted in a range of from about 6 to about 10 by using an alkali, such as sodium hydroxide or potassium hydroxide.

Epihalohydrins or $\alpha,\gamma$-dihalo-$\beta$-hydrins (b2) are explained hereunder.

Epihalohydrin as cross-linking compound (b) is represented by formula:

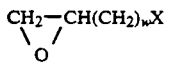

wherein X represents a halogen atom, and w represents an integer of 1, 2 or 3.

$\alpha,\gamma$-Dihalo-$\beta$-hydrin as cross-linking compound (b) is represented by formula:

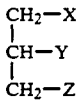

wherein X and Z each independently represent a halogen atom, and Y represents a hydroxyl group.

Preferred examples of the epihalohydrin include epichlorohydrin and epibromohydrin, and preferred examples of the $\alpha,\gamma$-dihalo-$\beta$-hydrin include 1,3-dichloro-2-propanol. These epihalohydrins and $\alpha,\gamma$-dihalo-$\beta$-hydrins can be used either alone or in combination.

The reaction of condensation product (a) with epihalohydrin or $\alpha,\gamma$-dihalo-$\beta$-hydrin (b2) is preferably conducted under a condition of a pH of 5 or higher, more preferably at a pH ranging from 6 to 9, and at a temperature of from about 30° to about 90° C., more preferably from about 40° to about 80° C., for from about 1 to about 10 hours. Epihalohydrin or $\alpha,\gamma$-dihalo-$\beta$-hydrin (b2) is used preferably in an amount of from about 0.1 to about 3 mols, more preferably from about 0.3 to about 2 mols, per mol of condensation product (a).

Water-soluble resin (A) prepared by the reaction of the condensation product (a) with aldehyde (b1) or epihalohydrin or $\alpha,\gamma$-dihalo-$\beta$-hydrin (b2) is obtained in the state of an aqueous solution, and preferably has a viscosity of from 50 to 1,000 cps at 25° C. and a pH of from 6 to 10, each in an aqueous solution of 60% by weight.

Where reaction product (b3) of urea compound (b3-1) and glyoxal (b3-2) is used as cross-linking compound (b), examples of urea compound (b3-1) to be used therein include those exemplified hereinabove as component (a2). Reaction product (b3) can be obtained, as usually practiced, by admixing urea compound (b3-1) and glyoxal (b3-2) in the presence of water. In this procedure, glyoxal (b3-2) is used preferably in an amount of from about 0.5 to about 5 mols per mol of urea compound (b3-1). Reaction product (b3) may be methylolized by the reaction with formaldehyde before or after urea compound (b3-1) is allowed to react with glyoxal (b3-2). The methylolized product may be further converted to an alkyl etherified product or a polyoxyalkylene etherified product. Alternatively, there can also be used, for example, those polymerized with a monomer having an amide group, such as acrylamide or methacrylamide, before or after urea compound (b3-1) is allowed to react with glyoxal (b3-2); and those reacted with a polymer having an amide group, such as polyacrylamide or polymethacrylamide, after urea compound (b3-1) is allowed to react with glyoxal (b3-2).

Such reaction product (b3) is further subjected to the cross-linking reaction with condensation product (a) to obtain water-soluble resin (A). Preferably, the aqueous solution containing condensation product (a) and reaction product (b3) is adjusted to a pH of 7 or below, more preferably to a pH ranging from 1 to 5, by using an acid such as hydrochloric acid, sulfuric acid, phosphoric acid, formic acid or acetic acid, and thereafter, the reaction is conducted at from about 40° to about 80° C. for about 1 to about 10 hours. After completion of the reaction, an aqueous solution of water-soluble resin (A) to be used in the present invention is obtained, the pH of which may be adjusted, if necessary, in a range of from about 6 to about 10 by using an alkali, such as sodium hydroxide or potassium hydroxide.

Water-soluble resin (A) prepared by the reaction of condensation product (a) with reaction product (b3) is obtained in the state of an aqueous solution, and preferably has a viscosity of from 50 to 1,000 cps at 25° C. and a pH of from 6 to 10, each in the aqueous solution of 60% by weight.

Where melamine-formaldehyde resin (b4) is used as crosslinking compound (b), resin (b4) can be produced by known methods, for example, those disclosed in U.S. Pat. No. 2,197,357.

Melamine-formaldehyde resin (b4) is subjected to the cross-linking reaction with condensation product (a) to obtain water-soluble resin (A). Preferably, the aqueous solution containing condensation product (a) and melamineformaldehyde resin (b4) is adjusted to a pH of 7 or below, more preferably to a pH ranging from 2 to 6, by using an acid such as hydrochloric acid, sulfuric acid, phosphoric acid, formic acid or acetic acid, and thereafter, the reaction is conducted at from about 40° to about 80° C. for from about 1 to about 10 hours. Melamine-formaldehyde resin (b4) is used preferably in an amount, based on the melamine nucleus, of from about 0.02 to about 2 mols, more preferably from about 0.1 to about 1 mol, per mol of condensation product (a).

After completion of the reaction, an aqueous solution of water-soluble resin (A) to be used in the present invention is obtained, the pH of which may be adjusted, if necessary, in the range of from about 6 to about 10 by using an alkali, such as sodium hydroxide or potassium hydroxide. Watersoluble resin (A) prepared by the reaction of condensation product (a) with melamine-formaldehyde resin (b4) is obtained in the state of an aqueous solution, and preferably has a viscosity of from 50 to 1,000 cps at 25° C. and a pH of from 6 to 10, each in the aqueous solution of 60% by weight.

Water-soluble resin (A) prepared by any of the abovementioned reactions can be used as resinous ingredient (III) of the paper coating composition according to the present invention. It is also possible to use two or more of the cross-linking compounds (b) in the preparation of watersoluble resin (A).

For example, when cross-linking compound (b) is reaction product (b3) of urea compound (b3-1) with glyoxal (b3-2), water-soluble resin (A) prepared from condensation product (a) and reaction product (b3) may further react with at least one compound selected from aldehydes, epihalohydrins and $\alpha,\gamma$-dihalo-$\beta$-hydrins to obtain another water-soluble resin (A1). Examples of these aldehydes, epihalohydrins and $\alpha,\gamma$-dihalo-$\beta$-hydrins are the same as those exemplified in the aforementioned components (b1) and (b2).

When water-soluble resin (A) is allowed to further react with aldehyde (b1), it is preferred to adjust the aqueous solution containing both reactants to a pH of 7 or below, more preferably to a pH ranging from 3 to 6, by using an acid, such as hydrochloric acid, sulfuric acid, phosphoric acid, formic acid or acetic acid, and thereafter to conduct the reaction at from about 40° to about 80° C. for from about 1 to about 10 hours. Alternatively, it is also preferred to conduct the reaction at first in an alkaline region of a pH ranging from 8 to 12, and then to continue the reaction by adjusting the pH to an acidic region of 7 or less, more preferably to a range of from 3 to 6. In the latter case, the reaction under the alkaline condition is conducted at from about 40° to about 80° C. for from about 1 to about 10 hours. Aldehyde (b1) is used preferably in such an amount that the aldehyde group therein is from about 0.1 to about 3 mols per mol of water-soluble resin (A). After completion of the reaction, water-soluble resin (Al) to be used in the present invention is obtained, if necessary by adjusting the pH in a range of from 6 to 10 with the use of an alkali such as sodium hydroxide or potassium hydroxide.

When water-soluble resin (A) prepared from alkylenedimine or polyalkylenepolyamine (a) and reaction product (b3) is allowed further to react with epihalohydrin or $\alpha,\gamma$-dihalo-$\beta$-hydrin (b2), it is preferred to conduct the reaction at a pH of 5 or higher, more preferably at a pH of from 6 to 9, at a temperature of from about 30° to about 90° C., more preferably from about 40° to about 80° C., for a period of from about 1 to about 10 hours. Epihalohydrin or $\alpha,\gamma$-dihalo-$\beta$-hydrin (b2) is used preferably in an amount of from about 0.1 to about 3 mols per mol of water-soluble resin (A).

The aldehyde, epihalohydrin and $\alpha,\gamma$-dihalo-$\beta$-hydrin to be used to obtain water-soluble resin (Al) can be used either alone or in combination of two or more thereof. For example, the aldehyde and the epihalohydrin may be used simultaneously, and also the aldehyde and the $\alpha,\gamma$-dihalo-$\beta$-hydrin may be used simultaneously.

Water-soluble resin (Al) is obtained also in the state of an aqueous solution, and preferably has a viscosity of from 50 to 1,000 cps at 25° C. and a pH of from 6 to 10, each in an aqueous solution of 60% by weight.

Water-soluble resin (A) including resin (Al) is generally used in the state of an aqueous solution to prepare the paper coating composition according to the present invention, and as described above, the aqueous solution containing resin (A) in a concentration of 60% by weight has preferably a viscosity of from 50 to 1,000 cps at 25° C. and a pH of from 6 to 10.

The paper coating composition according to the present invention comprises pigment (I), water-soluble binder (II), and resinous ingredient (III) containing water-soluble resin (A). Resinous ingredient (III) may consist solely of watersoluble resin (A) or may further contain other components. For example, resinous ingredient (III) may contain, in addition to water-soluble resin (A), polyamine (B) selected from (c) polyalkylenepolyamine and (d) reaction product of a polyalkylenepolyamine with a quaternarization agent. Further, water-soluble resin (A) in resinous ingredient (III) may be in the form of a reaction product with other components. For example, a reaction product (C) obtained by reacting water-soluble resin (A) with polyamine (B) may be used as resinous ingredient (III).

Polyalkylenepolyamine (c), which is per se polyamine (B) or a starting compound of polyamine (B), is a compound having two primary amino groups and at least one secondary amino group per molecule. Specific examples of such compounds include diethylenetriamine, triethylenetetramine, tetraethylenepentamine, iminobispropylamine, 3-azahexane1,6-diamine, and 4,7-diazadecane-1,10-diamine.

Examples of quaternarization agents to be reacted with the polyalkylenepolyamine to prepare another polyamine (B) are shown below.

(1) Halogen-containing compounds represented by formula:

$$R^1-X$$

wherein $R^1$ represents a lower alkyl group (e.g., having from 1 to about 6 carbon atoms), a lower alkenyl group (e.g., having from 2 to about 6 carbon atoms), a benzyl group, or a phenoxyethyl group; and X represents a halogen atom.

Preferred examples thereof include methyl chloride, ethyl chloride, propyl chloride, allyl chloride, benzyl chloride, phenoxyethyl chloride, and corresponding bromides or iodides.

(2) Dialkyl sulfites and dialkyl sulfates represented by formula:

$$(R^2O)_2SO_v$$

wherein $R^2$ represents a lower alkyl group (e.g., having from 1 to about 6 carbon atoms); and v represents an integer of 1 or 2.

Preferred examples thereof include dimethyl sulfate, diethyl sulfate, dimethyl sulfite and diethyl sulfite.

(3) Ethylene oxides represented by formula:

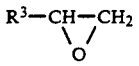

wherein $R^3$ represents a hydrogen atom, a lower alkyl group (e.g., having from 1 to about 6 carbon atoms), a hydroxylower alkyl group (e.g., having from 1 to about 6 carbon atoms), or a phenyl group.

Preferred examples thereof include ethylene oxide, propylene oxide, butylene oxide, styrene oxide and glycidol.

(4) Epihalohydrins represented by formula:

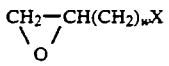

wherein X represents a halogen atom; and w represents an integer of 1, 2 or 3.

Preferred examples thereof include epichlorohydrin and epibromohydrin.

(5) Monohalohydrins represented by formula:

$$HOCH_2(CH_2)_wX$$

wherein X represents a halogen atom, and w represents an integer of 1, 2 or 3.

Preferred examples thereof include ethylenechlorohydrin and ethylenebromohydrin.

(6) Dihalohydrins represented by formula:

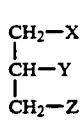

wherein X represents a halogen atom, and either one of Y and Z represents a halogen atom and the other represents a hydroxyl group.

Preferred examples thereof include 1,3-dichloro-2-propanol and 2,3-dichloro-1-propanol.

Particularly preferred of these quaternarization agents is epichlorohydrin. The quaternarization agents may be used either individually or in combination.

Polyamine (B) may be either one or both of polyalkylenepolyamine (c) and reaction product (d) between polyalkylenepolyamine (c) and the quaternarization agent.

Pigments which can be used as component (I) in the present invention include white inorganic pigments, e.g., kaolin, talc, calcium carbonate (either ground or precipitated), aluminum hydroxide, satin white and titanium oxide; and white organic synthetic pigments, e.g., polystyrene, melamine-formaldehyde resins, and ureaformaldehyde resins. They may be used either individually or in combination of two or more thereof. Organic or inorganic colored pigments may also be used in combination.

Aqueous binders which can be used in the present invention as component (II) include water-soluble binders and aqueous emulsion type binders. Examples of the watersoluble binders include modified or unmodified starches such as oxidized starch and phosphate-esterified starch, polyvinyl alcohol, water-soluble proteins such as casein and gelatin, and modified cellulose such as carboxymethyl-cellulose. Examples of the aqueous emulsion type binders include styrene-butadiene type resins, vinyl acetate resins, ethylene-vinyl acetate resins, and methyl methacrylate-based resins. These aqueous binders may be used either individually or in combination of two or more thereof.

In the paper coating composition according to the present invention, resinous ingredient (III) is used preferably in an amount of from 0.05 to 5 parts by weight, more preferably from 0.1 to 2 parts by weight, per 100 parts by weight of pigment (I). The amount of resinous ingredient (III) referred to herein is applicable to any of cases where the resinous ingredient (III) comprises water-soluble resin (A) alone, where it comprises both water-soluble resin (A) and polyamine (B), and where it comprises reaction product (C) prepared by further reacting water-soluble resin (A) with polyamine (B).

Aqueous binder (II) per se is conventionally used as a component for paper coating compositions, and its amount in the composition can vary in accordance with the usage of the composition. Aqueous binder (II) contained in the paper coating composition of the present invention is preferably in an amount of from 5 to 200 parts by weight, more preferably from 10 to 50 parts by weight, per 100 parts by weight of pigment (I).

The paper coating composition of the present invention preferably has a solids content ranging from about 20 to about 75% by weight based on the weight of the composition, but the solid content can vary depending on the kind of a coater, the usage of the composition and the like.

In the preparation of the paper coating composition of the present invention, while resinous ingredient (III) is usually admixed with the pigment and aqueous binder at the preparation of the composition, the effects of the present invention can be achieved as well by previously admixing resinous ingredient (III) with either a pigment slurry or an aqueous binder and then incorporating the mixture with other components.

If desired, the paper coating composition of the present invention may further contain other components, such as dispersing agents, viscosity or fluidity regulators, defoaming agents, antiseptics, lubricants, water retaining agents, and colorants including dyes and colored pigments.

The paper coating composition of the present invention can be applied on a paper substrate by any of known coating means, such as blade coater, air knife coater, bar coater, size press coater, gate roll coater, and cast coater. After coating, the paper is subjected to drying as required. If desired, the coated paper is subjected to a surface smoothening treatment by use of a supercalender, etc.

Coated paper obtained by using the paper coating composition according to the present invention exhibits various excellent properties. For example, it excellent ink receptivity and water resistance, and has particularly excellent anti-blister properties. Further, it is completely or substantially free from evolution of formaldehyde odor.

The present invention is now illustrated in greater detail with reference to Reference Examples and Examples, but it should be understood that the present invention is not deemed to be limited thereto. All the percents, parts and ratios are by weight unless otherwise indicated. In the Reference Examples and Examples, viscosities were measured at 25° C.

REFERENCE EXAMPLE 1

In a four-necked flask equipped with a thermometer, a reflux condenser, and a stirring rod were charged 146.2 g (1.0 mol) of triethylenetetramine and 180.2 g (3.0 mol) of urea, and the mixture was heated at an inner temperature of 120–140° C. for 2 hours to effect deammoniation. Thereafter, 150.4 g of water was added thereto to prepare an aqueous resin solution. To the solution was added 56.8 g (0.7 mol) of 37% formalin, and the mixture was allowed to react at 70° C for 4 hours. The reaction system was adjusted to pH 4.0 with 70% sulfuric acid, and the reaction was further continued at 70° C. for an additional period of 4 hours. The reaction mixture was adjusted to pH 7.0 with an aqueous sodium hydroxide solution to obtain an aqueous water-soluble resin solution R1having a resin content of 60% and a viscosity of 350 cps.

REFERENCE EXAMPLE 2

In the same apparatus as used in Reference Example 1 were charged 146.2 g (1.0 mol) of triethylenetetramine and 60.1 g (1.0 mol) of urea, and the mixture was heated at an inner temperature of 140–160° C. for 3 hours to effect deammoniation. After cooling to 120° C., 120.1 g (2.0 mol) of urea was added to the reaction mixture, followed by heating at an inner temperature of 120–130° C. for 2 hours to conduct deammoniation. Then, 134.9 g of water was added thereto to prepare an aqueous resin solution. To the solution was added 81.2 g (1.0 mol) of 37% formalin, and the mixture was allowed to react at 70° C. for 4 hours. After adjusting to pH 4.0 with 70% sulfuric acid, the reaction mixture was further allowed to react at 70° C. for 4 hours. The reaction mixture was adjusted to pH 7.0 with an aqueous sodium hydroxide solution to obtain an aqueous water-soluble resin solution R2 having a resin content of 60% and a viscosity of 230 cps.

REFERENCE EXAMPLE 3

In the same apparatus as used in Reference Example 1 were charged 103.2 g (1.0 mol) of diethylenetriamine and 120.1 g (2.0 mol) of urea, and the mixture was heated at an inner temperature of 120–140° C. for 2 hours to remove ammonia. Then, 33.6 g of water was added thereto to prepare an aqueous resin solution. To the solution was added 81.2 g (1.0 mol) of 37% formalin, and the mixture was allowed to react at 70° C for 4 hours. After adjusting to pH 4.0 with 70% sulfuric acid, the reaction mixture was further allowed to react at 70° C. for 4 hours. The reaction mixture was adjusted to pH 7.0 with an aqueous sodium hydroxide solution to obtain an aqueous water-soluble resin solution R3 having a resin content of 60% and a viscosity of 540 cps.

REFERENCE EXAMPLE 4

Deammoniation reaction was conducted in the same manner as in Reference Example 1. To the resulting reaction mixture was added 215.4 g of water, and 64.8 g (0.7 mol) of epichlorohydrin was further added thereto. The mixture was allowed to react at 70° C. for 4 hours to obtain an aqueous water-soluble resin solution R4 having a resin content of 60%, a viscosity of 300 cps and a pH of 6.2.

REFERENCE EXAMPLE 5

To 465.5 g of an aqueous water-soluble resin solution obtained in the same manner as in Reference Example 1 were added 14.6 g (0.1 mol) of triethylenetetramine and 9.1 g of water to obtain an aqueous water-soluble resin solution R5 having a resin content of 60%, a viscosity of 340 cps and a pH of 8.0.

REFERENCE EXAMPLE 6

In the same apparatus as used in Reference Example 1 were charged 43.9 g (0.3 mol) of triethylenetetramine and 140.3 g of water, and 166.6 g (1.8 mol) of epichlorohydrin was further added thereto dropwise while keeping the inner temperature at 50° C. or lower. To the reaction mixture was added 465.5 g of an aqueous water-soluble resin solution obtained in the same manner as in Reference Example 1, followed by allowing the mixture to react at 50° C. for 1 hour to prepare an aqueous water-soluble resin solution R6 having a resin content of 60%, a viscosity of 300 cps and a pH of 6.5.

COMPARATIVE REFERENCE EXAMPLE 1

In a four-necked flask equipped with a thermometer, a reflux condenser, and a stirring rod were charged 146.2 g (1.0 mol) of triethylenetetramine and 30.0 g (0.5 mol) of urea, and the mixture was heated at an inner temperature of 140–160° C. for 3.5 hours to conduct deammoniation. Thereafter, 73.1 g (0.5 mol) of adipic acid was added thereto to conduct deamidation at 150–160° C. for 5 hours. After cooling to 130° C., 120.1 g (2.0 mol) of urea was added to the reaction mixture, and ammonia was removed at 120–130° C. for 2 hours. Then, 284.5 g of water was added thereto to prepare an aqueous resin solution. To the solution was added 60.9 g (0.75 mol) of 37% formalin, and the system was adjusted to a pH of 4–5 with 70% sulfuric acid, followed by allowing the mixture to react at an inner temperature of 70° C. for 4 hours. The pH of the reaction mixture was adjusted to 6.5 with an aqueous sodium hydroxide solution to obtain an aqueous resin solution CR1 having a resin content of 50% and a viscosity of 140 cps.

COMPARATIVE REFERENCE EXAMPLE 2

The same procedures as in Reference Example 1 were repeated, except for changing the amounts of urea and water charged to 90.1 g (1.5 mol) and 101.7 g, respectively, to obtain an aqueous resin solution CR2 having a resin content of 60%, a viscosity of 200 cps and a pH of 7.0.

COMPARATIVE REFERENCE EXAMPLE 3

The same procedures as in Reference Example 1 were repeated, except for changing the amounts of urea and water charged to 300.3 g (5 mol) and 230.5 g, respectively, to obtain an aqueous resin solution CR3 having a resin content of 60%, a viscosity of 150 cps and a pH of 7.0.

COMPARATIVE REFERENCE EXAMPLE 4

The same procedures as in Reference Example 1 were repeated, except that the reaction after the addition of sulfuric acid was not conducted. There was obtained an aqueous resin solution CR4 having a resin content of 60%, a viscosity of 60 cps and a pH of 8.5.

COMPARATIVE REFERENCE EXAMPLE

The same procedures as in Reference Example 1 were repeated, except for changing the amounts of 37% formalin and water charged to 73.0 g (0.9 mol) and 144.2 g, respectively, to obtain an aqueous resin solution CR5 having a resin content of 60%, a viscosity of 1,600 cps and a pH of 7.0.

COMPARATIVE REFERENCE EXAMPLE 6

Reactions were conducted in the same manner as in Reference Example 1. The resulting reaction mixture was adjusted to pH 4.0 with 70% sulfuric acid to obtain an aqueous resin solution CR6 having a resin content of 60% and a viscosity of 350 cps.

COMPARATIVE REFERENCE EXAMPLE 7

Reactions were conducted in the same manner as in Reference Example 1. The resulting reaction mixture was tried to be adjusted to pH 11 with an aqueous sodium hydroxide solution. However, a precipitate was formed in quantity, and a satisfactory aqueous resin solution was not obtained.

EXAMPLE 1

A paper coating composition having the following formulation (solid base) was prepared by using each of the aqueous water-soluble resin solutions R1 to R6 and CR1 to CR6 prepared in Reference Examples 1 to 6 and Comparative Reference Examples 1 to 6. The coating compositions using any of the resin solutions CR2, CR5 and CR6 prepared in Comparative Reference Examples 2, 5, and 6 had a too high viscosity to conduct a coating test hereinafter described.

| Paper Coating Composition: | | |
|---|---|---|
| Pigment: | Ultrawhite 90[1] | 70 parts |
| | Carbital 90[2] | 30 parts |
| Dispersing Agent: | Sumirez Resin DS-10[3] | 0.2 part |
| Aqueous Binder: | SN-307[4] | 12 parts |
| | Oji Ace A[5] | 4 parts |
| Water-soluble Thermosetting Resin: | Aqueous resin solution obtained in Reference Example or Comparative | 0.5 parts |

-continued

| Paper Coating Composition: | |
|---|---|
| | Reference Example |

Note:
[1]Clay produced by Engel Hard Minerals and Chemical Division Inc., U.S.A.
[2]Calcium carbonate produced by Fuji Kaolin Co., Ltd., Japan
[3]Polyacrylic acid type pigment dispersant produced by Sumitomo Chemical Co., Ltd., Japan
[4]Styrene-butadiene latex produced by Sumitomo Naugatuck Co., Ltd., Japan
[5]Oxidized starch produced by Oji National Co., Ltd., Japan The paper coating composition was adjusted so as to have a total solids content of 60% and a pH of about 9.0 by addition of water and an aqueous 10% sodium hydroxide solution. The thus prepared composition was applied using a wire rod on one or both sides of fine paper having a basis weight of 80 g/m$^2$ at a single spread of 14 g/m$^2$. The paper was immediately subjected to drying in hot air at 120° C. for 30 seconds, then to moisture-conditioning at 20° C. under a relative humidity of 65% for 16 hours, and thereafter to supercalendering twice at 60° C. and under a linear pressure of 60 kg/cm to obtain coated paper.

Water resistance, ink receptivity, and anti-blister property of the resulting coated paper were evaluated in accordance with the following test methods. The results obtained are shown in Table 1 below.

(1) Water Resistance:

(1-a) Wet Rub Method (WR)

About 0.1 ml of ion-exchange water was dropped on the coated surface, and 7 rubs with a finger tip were given. The matter rubbed off was transferred to black paper, and its amount was visually observed to evaluate water resistance according to five ratings of from 1 (poor) to 5 (excellent).

(1-b) Wet Pick Method (WP)

The coated surface was wetted with a water-supply roll and printed by means of an RI tester (manufactured by Akira Seisakusho Co., Ltd.). The picking was visually observed to evaluate water resistance according to five ratings of from 1 (poor) to 5 (excellent).

(2) Ink Receptivity (2-a) Method A

The coated surface was wetted with a water-supply roll and printed by means of the RI tester. Ink receptivity was visually evaluated according to five ratings of from 1 (poor) to 5 (excellent).

(2-b) Method B:

Printing was carried out while incorporating water into ink by means of the IR tester. Ink receptivity was visually evaluated according to five ratings of from 1 (poor) to 5 (excellent).

(3) Anti-blister property

Both sides of double-coated paper were printed with offset rotary pressing ink by means of the RI tester. After moisture-conditioning, the printed paper was soaked in a heated silicone oil bath, and the amount of blisters was visually evaluated according to five ratings of from 1 (poor) to 5 (excellent).

TABLE 1

| | Invention | | | | | | Comparison | | | Blank |
|---|---|---|---|---|---|---|---|---|---|---|
| | Run No. 1 | Run No. 2 | Run No. 3 | Run No. 4 | Run No. 5 | Run No. 6 | Run No. 7 | Run No. 8 | Run No. 9 | Run No. 10 |
| Coating Composition: | | | | | | | | | | |
| Resin | R1 | R2 | R3 | R4 | R5 | R6 | CR1 | CR3 | CR4 | none |

TABLE 1-continued

| | Invention | | | | | | Comparison | | | Blank |
|---|---|---|---|---|---|---|---|---|---|---|
| | Run No. 1 | Run No. 2 | Run No. 3 | Run No. 4 | Run No. 5 | Run No. 6 | Run No. 7 | Run No. 8 | Run No. 9 | Run No. 10 |
| pH (25° C.) | 9.0 | 9.1 | 9.1 | 9.0 | 9.1 | 9.0 | 9.1 | 9.1 | 9.1 | 9.2 |
| Viscosity (25° C.) (cps) | 1,600 | 1,520 | 1,540 | 1,660 | 1,670 | 1,690 | 1,510 | 1,510 | 1,550 | 1,520 |
| Coated Paper: | | | | | | | | | | |
| Water resistance: | | | | | | | | | | |
| WR method | 4.0 | 4.2 | 4.4 | 4.5 | 4.3 | 4.5 | 3.0 | 2.8 | 2.3 | 1.0 |
| WP method | 4.3 | 4.4 | 4.3 | 4.5 | 4.2 | 4.2 | 3.0 | 3.3 | 2.8 | 1.0 |
| Ink receptivity: | | | | | | | | | | |
| Method A | 4.3 | 4.4 | 4.2 | 4.5 | 4.6 | 4.6 | 3.2 | 2.8 | 2.2 | 1.0 |
| Method B | 4.6 | 4.7 | 4.6 | 4.9 | 4.8 | 4.9 | 3.0 | 2.9 | 2.8 | 1.0 |
| Anti-blister property | 4.5 | 4.5 | 4.5 | 4.9 | 4.8 | 4.9 | 3.0 | 3.0 | 3.0 | 1.0 |

REFERENCE EXAMPLE 7

To a four-necked flask equipped with a thermometer, a reflux condenser, and a stirring rod were charged 146.2 g (1.0 mol) of triethylenetetramine and 180.2 g (3.0 mol) of urea, and the mixture was heated at an inner temperature of 120–140° C. for 2 hours to conduct deammoniation. Then, 156.1 g of water was added to prepare an aqueous resin solution. A resin solution separately prepared from 12.0 g (0.2 mol) of urea and 72.5 g (0.5 mol) of an aqueous 40% glyoxal solution was added to the above prepared aqueous resin solution, and the pH was adjusted to 4.0 with 70% sulfuric acid, followed by allowing the mixture to react at 70° C. for 4 hours. Thereafter, the pH was adjusted to 7.0 with an aqueous sodium hydroxide solution to obtain an aqueous water-soluble resin solution R7 having a resin content of 60% and a viscosity of 75 cps.

REFERENCE EXAMPLE 8

To 499.0 g of an aqueous water-soluble resin solution prepared in the same manner as in Reference Example 7 was added 40.6 g (0.5 mol) of 37% formalin, and the pH was adjusted to 4.0 with 70% sulfuric acid, followed by allowing the mixture to react at 70° C. for 4 hours. Thereafter, the pH was adjusted to 7.0 with an aqueous sodium hydroxide solution to obtain an aqueous water-soluble resin solution R8 having a resin content of 60% and a viscosity of 300 cps.

REFERENCE EXAMPLE 9

To 499.0 g of an aqueous water-soluble resin solution prepared in the same manner as in Reference Example 7 were added 46.3 g (0.5 mol) of epichlorohydrin and 30.9 g of water, and the pH was adjusted to 8.0 with an aqueous sodium hydroxide solution, followed by allowing the mixture to react at 70° C. for 4 hours to obtain an aqueous water-soluble resin solution R9 having a resin content of 60%, a viscosity of 290 cps and a pH of 6.6.

REFERENCE EXAMPLE 10

To 499.0 g of an aqueous water-soluble resin solution prepared in the same manner as in Reference Example 7 were added 14.6 g (0.1 mol) of triethylenetetramine and 9.1 g of water to obtain an aqueous water-soluble resin solution R10 having a resin content of 60%, a viscosity of 340 cps and a pH of 8.0.

REFERENCE EXAMPLE 11

In the same apparatus as used in Reference Example 7 were charged 43.9 g (0.3 mol) of triethylenetetramine and 140.3 g of water, and 166.6 g (1.8 mol) of epichlorohydrin was further added thereto dropwise while keeping the inner temperature at 50° C. or lower. To the reaction mixture was added 499.0 g of an aqueous resin solution prepared in the same manner as in Reference Example 7, and the resulting mixture was allowed to react at 50° C. for 1 hour to obtain an aqueous water-soluble resin solution R11 having a resin content of 60%, a viscosity of 300 cps and a pH of 6.5.

EXAMPLE 2

A paper coating composition was prepared in the same manner as in Example 1, except for using each of the resin solutions R7 to R11 prepared in Reference Examples 7 to 11. Each of the resulting compositions was evaluated in the same manner as in Example 1. The results obtained are shown in Table 2 below.

TABLE 2

| | Invention | | | | | Comparison | Blank |
|---|---|---|---|---|---|---|---|
| | Run No. 1 | Run No. 2 | Run No. 3 | Run No. 4 | Run No. 5 | Run No. 6 | Run No. 7 |
| Coating Composition: | | | | | | | |
| Resin | R7 | R8 | R9 | R10 | R11 | CR1 | none |
| pH (25° C.) | 9.1 | 9.1 | 9.2 | 9.0 | 9.1 | 9.1 | 9.3 |
| Viscosity (25° C.) (cps) | 1,690 | 1,720 | 1,730 | 1,750 | 1,740 | 1,600 | 1,610 |
| Coated Paper: | | | | | | | |
| Water resistance: | | | | | | | |
| WR method | 4.1 | 4.1 | 4.3 | 4.4 | 4.3 | 3.0 | 1.0 |
| WP method | 4.2 | 4.0 | 4.2 | 4.4 | 4.2 | 3.0 | 1.0 |
| Ink receptivity: | | | | | | | |
| Method A | 4.3 | 4.5 | 4.2 | 4.5 | 4.5 | 3.2 | 1.0 |
| Method B | 4.7 | 4.8 | 4.6 | 4.9 | 4.7 | 3.0 | 1.0 |

TABLE 2-continued

| | Invention | | | | | Comparison | Blank |
|---|---|---|---|---|---|---|---|
| | Run No. 1 | Run No. 2 | Run No. 3 | Run No. 4 | Run No. 5 | Run No. 6 | Run No. 7 |
| Anti-blister property | 4.5 | 4.6 | 4.7 | 4.9 | 4.8 | 3.0 | 1.0 |

REFERENCE EXAMPLE 12

In a four-necked flask equipped with a thermometer, a reflux condenser, and a stirring rod were charged 146.2 g (1.0 mol) of triethylenetetramine and 180.2 g (3.0 mol) of urea, and the mixture was heated at an inner temperature of 120–140° C. for 2 hours to perform deammoniation. To the mixture was added 191.1 g of water to prepare an aqueous resin solution. To the solution was added 75.8 g (0.25 mol) of an aqueous 75% melamine resin solution prepared by using 3.3 mol of formaldehyde per mol of melamine, and the pH of the mixture was adjusted to 4.0 with 70% sulfuric acid, followed by allowing the mixture to react at 70° C. for 4 hours. The reaction mixture was adjusted to pH 7.0 with an aqueous sodium hydroxide solution to obtain an aqueous watersoluble resin solution R12 having a resin content of 60% and a viscosity of 340 cps.

REFERENCE EXAMPLE 13

To 525.2 g of an aqueous resin solution prepared in the same manner as in Reference Example 12 were added 14.6 g (0.1 mol) of triethylenetetramine and 9.1 g of water to prepare an aqueous water-soluble resin solution R13 having a resin content of 60%, a viscosity of 330 cps and a pH of 8.0.

REFERENCE EXAMPLE 14

To the same apparatus as used in Reference Example 12 were added 43.9 g (0.3 mol) of triethylenetetramine and 140.3 g of water, and 166.6 g (1.8 mol) of epichlorohydrin was further added thereto dropwise while keeping the inner temperature at 50° C. or lower. To the mixture was added 525.2 g of an aqueous resin solution prepared in the same manner as in Reference Example 12, followed by allowing the resulting mixture to react at 50° C. for 1 hour to prepare an aqueous water-soluble resin solution R14 having a resin content of 60%, a viscosity of 300 cps and a pH of 6.5.

EXAMPLE 3

A paper coating composition was prepared in the same manner as in Example 1, except for using each of the resin solutions R12 to R14 prepared in Reference Examples 12 to 14. Each of the resulting composition was evaluated in the same manner as in Example 1. The results obtained are shown in Table 3 below.

TABLE 3

| | Invention | | | Comparison | Blank |
|---|---|---|---|---|---|
| | Run No. 1 | Run No. 2 | Run No. 3 | Run No. 4 | Run No. 5 |
| Coating Composition: | | | | | |
| Resin | R12 | R13 | R14 | CR1 | none |
| pH (25° C.) | 9.1 | 9.1 | 9.0 | 9.1 | 9.2 |
| Viscosity (25° C.) (cps) | 1,630 | 1,690 | 1,760 | 1,600 | 1,620 |
| Coated Paper: | | | | | |
| Water resistance: | | | | | |
| WR method | 4.3 | 4.1 | 4.2 | 3.0 | 1.0 |

TABLE 3-continued

| | Invention | | | Comparison | Blank |
|---|---|---|---|---|---|
| | Run No. 1 | Run No. 2 | Run No. 3 | Run No. 4 | Run No. 5 |
| WP method | 4.3 | 4.3 | 4.3 | 3.0 | 1.0 |
| Ink receptivity: | | | | | |
| Method A | 4.2 | 4.3 | 4.4 | 3.2 | 1.0 |
| Method B | 4.1 | 4.7 | 4.7 | 3.0 | 1.0 |
| Anti-blister property | 4.5 | 4.6 | 4.7 | 3.0 | 1.0 |

While the invention has been described in detail and with reference to specific examples thereof, it will be apparent to one skilled in the art that various changes and modifications can be made therein without departing from the spirit and scope thereof.

What is claimed is:

1. A paper coating composition which comprises:

(I) a pigment, (II) an aqueous binder, and (III) a resinous ingredient comprising (A) a water-soluble resin which is prepared from the components consisting essentially of (a) a condensation product of (a1) an alkylenediamine or a polyalkylenepolyamine and (a2) an urea compound, and (b) a cross-linking compound, by cross-linking said condensation product (a) with said cross-linking compound (b) in an aqueous solution.

2. The composition according to claim 1, wherein said alkylenediamine or polyalkylenepolyamine (al) is selected from the group consisting of diethylenetriamine and triethylenetetramine.

3. The composition according to claim 1, wherein said urea compound (a2) is urea.

4. The composition according to claim 1, wherein said urea compound (a2) is used in an amount of from 0.5 to 1 mol per mol of the primary and secondary amino groups contained in said alkylenediamine or polyalkylenepolyamine (a1).

5. The composition according to claim 1, wherein said cross-linking compound (b) is (b1) an aldehyde, and said resin (A) is prepared under a cross-linking condition of a pH of 7 or below.

6. The composition according to claim 5, wherein said aldehyde (b1) is formaldehyde or glyoxal.

7. The composition according to claim 5, wherein said resin (A) is prepared by first reacting the condensation product (a) and the aldehyde (b1) at a pH ranging from 8 to 12, and thereafter conducting the crosslinking reaction at a pH of 7 or below.

8. The composition according to claim 1, wherein said cross-linking compound (b) is (b2) an epihalohydrin or an $\alpha,\gamma$-dihalo-$\beta$-hydrin.

9. The composition according to claim 8, wherein said resin (A) is prepared by the reaction at a pH of 5 or higher.

10. The composition according to claim 1, wherein said cross-linking compound (b) is (b3) a reaction product of (b3-1) an urea compound with (b3-2) glyoxal.

11. The composition according to claim 10, wherein said resin (A) is prepared by the reaction at a pH of 7 or below.

12. The composition according to claim 10, wherein said water-soluble resin (A) prepared from the condensation product (a) and the reaction product (b3) further react with a compound selected from the group consisting of an aldehyde, an epihalohydrin and an $\alpha,\gamma$-dihalo-$\beta$-hydrin.

13. The composition according to claim 1, wherein said cross-linking compound (b) is (b4) a melamine-formaldehyde resin.

14. The composition according to claim 13, wherein said resin (A) is prepared by the reaction at a pH of 7 or below.

15. The composition according to claim 1, wherein the water-soluble resin (A) has a viscosity of from 50 to 1,000 cps at 25° C. and a pH of from 6 to 10, each in an aqueous solution of 60% by weight.

16. The composition according to claim 1, wherein said resinous ingredient (III) further comprises (B) a polyamine selected from the group consisting of (c) a polyalkylenepolyamine and (d) a reaction product of a polyalkylenepolyamine with a quaternarization agent.

17. The composition according to claim 1, wherein said resinous ingredient (III) is (C) a reaction product prepared from the water-soluble resin (A) by further reacting with (B) a polyamine selected from the group consisting of (c) a polyalkylenepolyamine and (d) a reaction product of a polyalkylenepolyamine with a quaternarization agent.

18. The composition according to claim 1, wherein said resinous ingredient (III) is present in an amount of from 0.05 to 5 parts by weight per 100 parts by weight of the pigment (I).

19. The composition according to claim 1, wherein said aqueous binder (II) is present in an amount of from 5 to 200 parts by weight per 100 parts by weight of the pigment (I).

20. The composition according to claim 1, which comprises 100 parts by weight of the pigment (I), from 10 to 50 parts by weight of the aqueous binder (II), and from 0.1 to 2 parts by weight of the resinous ingredient (III).

* * * * *